US006302388B1

(12) United States Patent
Graushar et al.

(10) Patent No.: US 6,302,388 B1
(45) **Date of Patent: *Oct. 16, 2001**

(54) APPARATUS AND METHOD FOR SECURING AN ITEM TO A COVER OF PRINTED MATERIAL

(75) Inventors: William T. Graushar, Wauwatosa; John C. Geres, West Allis, both of WI (US)

(73) Assignee: Quad/Graphics, Inc., Sussex, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/373,339

(22) Filed: Aug. 12, 1999

Related U.S. Application Data

(63) Continuation-in-part of application No. 08/866,992, filed on Jun. 2, 1997, which is a continuation-in-part of application No. 08/562,258, filed on Nov. 22, 1995, now Pat. No. 5,634,633.

(51) Int. Cl.[7] ..... B41F 13/54; B65H 39/02

(52) U.S. Cl. ..... 270/1.02; 270/58.05; 412/4; 412/13; 412/19

(58) Field of Search ..... 270/58.04, 58.05, 270/52.16, 1.02; 412/3, 4, 13, 19

(56) References Cited

U.S. PATENT DOCUMENTS

| | | | |
|---|---|---|---|
| 4,022,455 | 5/1977 | Newsome et al. | 270/54 |
| 4,270,967 | 6/1981 | Cone | 156/299 |
| 4,305,605 | 12/1981 | Vine | 281/35 |
| 4,319,948 | 3/1982 | Volkert et al. | 156/357 |
| 4,420,282 | 12/1983 | Axelrod | 412/4 |
| 4,505,467 | 3/1985 | Brocklehurst | 270/53 |
| 4,606,715 | 8/1986 | Larson | 425/110 |
| 4,851,074 | 7/1989 | Uchida | 156/541 |
| 4,971,647 | 11/1990 | Leslie | 156/249 |
| 4,989,850 | 2/1991 | Weller | 270/1.1 |
| 5,013,019 | 5/1991 | Samuels | 270/1.1 |
| 5,013,022 | 5/1991 | Graushar | 270/56 |
| 5,045,148 | 9/1991 | Hoffstetter et al. | 156/567 |
| 5,061,334 | 10/1991 | Paules | 156/235 |
| 5,100,116 | 3/1992 | Graushar | 270/1.1 |
| 5,114,128 | 5/1992 | Harris, Jr. et al. | 270/11 |
| 5,144,562 | 9/1992 | Stikkelorum et al. | 364/478 |
| 5,230,501 | 7/1993 | Melton | 270/41 |
| 5,232,324 | 8/1993 | Graushar | 412/4 |
| 5,275,685 | 1/1994 | Stauber | 156/556 |
| 5,316,425 | 5/1994 | Graushar et al. | 412/19 |
| 5,413,446 | 5/1995 | Rathert et al. | 412/17 |
| 5,417,535 | 5/1995 | Andjelic et al. | 412/2 |
| 5,634,633 | 6/1997 | Graushar | 270/58.05 |
| 5,988,620 * | 11/1999 | Graushar | 270/1.02 |

FOREIGN PATENT DOCUMENTS

| | | |
|---|---|---|
| 29614310U1 | 11/1996 | (DE) . |
| 29705528U1 | 7/1997 | (DE) . |

* cited by examiner

*Primary Examiner*—Hoang Nguyen
(74) *Attorney, Agent, or Firm*—Michael Best & Friedrich LLP

(57) ABSTRACT

The present invention concerns an apparatus and a method for securing an item to a cover of printed material. According to one aspect of the present invention, the item is displayed in such a manner so as to enable the item to be viewed through the cover but also reduce the appropriation of the item from the cover before the printed material reaches the end user.

13 Claims, 5 Drawing Sheets

14
30
16
22
18
50
34
38'
110
106
46
114
118
122
54
74
94
98
66
70
82
58
38'

APPARATUS AND METHOD FOR SECURING AN ITEM TO A COVER OF PRINTED MATERIAL

CROSS-REFERENCE TO RELATED APPLICATIONS

This is a continuation-in-part of U.S. application Ser. No. 08/866,992, filed Jun. 2, 1997, which is a continuation-in-part of U.S. application Ser. No. 08/562,258, filed Nov. 22, 1995 and issued as U.S. Pat. No. 5,634,633 on Jun. 3, 1997, both of which are hereby incorporated herein by reference.

FIELD OF THE INVENTION

The present invention relates, generally, to an apparatus and a method for securing an item to a cover of printed material (e.g., a magazine or the like) and, more particularly, to an apparatus and a method for securing items to covers of printed materials for advertising and promotional value, and thereafter securing the covers to respective book blocks (e.g., groups of signatures), all in the same in-line processing system.

BACKGROUND OF THE INVENTION

Collating and binding systems are well known in the printing industry for mass producing printed products, such as booklets, magazines, catalogues, advertising brochures and the like. Typically, one or more sharply folded and generally pre-printed blanks or signatures are sequentially fed by a number of spaced signature feeders. The signatures are delivered such that the signatures come to rest upon a collating conveyor which travels past the signature feeders. The conveyor gathers the signatures, one on top of the other, into a book block and moves the book block to a binding station where a cover is applied.

Recently, it has become desirable to secure items to printed products. As used herein, the term item refers to any object that is attached to a printed product by means other than by binding, and that is smaller (e.g., in surface area) than the printed product to which it is attached. For example, it may be desirable to secure a credit card, envelope, sample packet, computer diskette, musical CD, or other items to printed products. In order to accomplish this, it is known to glue the items directly to the individual signatures, one at a time, and then transport the signatures in a shingled stream to a downstream operation (e.g., the gatherer).

It can be appreciated that the transport of signatures from the attaching device to the subsequent operation can be difficult in view of the fact that the signatures have protruding items attached. This can result in problems associated with smooth transport of the signatures, particularly in a shingled stream. The problem is particularly evident in the case of magazine covers, which are typically fed individually from a stack by a cover feeder. Items secured to the covers tend to interfere with feeding the covers from the stack. U.S. Pat. No. 5,634,633 provides an apparatus and a method, in one aspect, to alleviate this problem by securing items to the covers after the covers are fed from the corresponding cover feeder, and before the covers are secured to signatures or book blocks.

Securing items to printed materials provides promotional and advertising benefits. However, existing apparatuses and methods often position items in areas of the printed materials other than the covers because this can be easier and more efficient to accomplish. In such cases, the items are not readily visible to subscribers or prospective purchasers absent the printed materials being opened- As a result, the initial advertising or promotional value of securing an item to a printed material is reduced.

Many existing apparatuses and methods require separate processes or processing lines to insert and secure items to printed materials and thereafter affix the created assemblies to book blocks. In other words, many existing apparatuses and methods require off-line procedures or separate processes if it is desired to secure items to the printed materials thereby diminishing the overall potential profit margin. Off-line procedures or separate procedures result in, as can be appreciated by those skilled in the art, among other things, increased production time and expenses.

Other known apparatuses and methods secure items to printed materials in off-line procedures but require a large amount of additional paper or stock which is then manipulated multiple times to provide a holding area for the items. As can be appreciated, using more paper or stock adds undesirable costs to the overall end products.

BRIEF SUMMARY OF THE INVENTION

There exists a need in the art for an apparatus and a method which secure items to the covers of printed materials such that the items are viewable without having to open the printed materials, for an apparatus and a method which are capable of accomplishing the foregoing feature in a single in-line processing system, for an apparatus and a method which allow items to be secured to the covers of printed materials without having to provide excessive material or stock for the covers, and for an apparatus and a method for securing items to the covers of printed materials which are more efficient and economical than what has hitherto been possible.

The present invention accomplishes the foregoing features and other features and solves the noted problems and other problems of the prior art by providing an apparatus and a method that secure items to covers before the covers are secured to signatures or book blocks. The covers preferably are adapted to enable the items secured thereto to be viewed from the outside without having to open the printed materials or book blocks. Moreover, items are secured to the covers and the covers are thereafter attached to book blocks in an in-line single operation, thereby eliminating the cost and complexity normally attributable to off-line or multiple step operations.

In one embodiment of the present invention, there is provided a cover applicator for attaching covers to signatures and a signature supplier appropriately positioned to provide at least one signature to the cover applicator. A cover stack feeder is positioned along a conveyor line of the cover applicator to feed covers to the conveyor line. A folding mechanism is positioned along the conveyor line for selectively folding the covers to create flap portions on the covers. Preferably, single flaps are created on the covers. An item feeder is properly positioned along the conveyor line to feed items in separated relation to the covers such that the items are placed under the respective flap portions of the covers. An adhesive applicator is positioned along the conveyor line to deposit adhesive between the flap portions and the respective mating portions of the covers. The flap portions are secured to the covers to create envelope areas adaptable to surround and secure the items to the covers. Once an item is secured to a cover, the cover is secured to a book block. Alternatively, a perforated flap, slot or the like may be provided in the flap portions or other portions of the covers so that the items may be removed from the envelope areas of the covers through the flaps or slots. The folded envelopes and perforated flaps or slots are designed such that the items secured to the covers cannot be removed from the covers absent an intervening force.

In one embodiment of the present invention, a plastic like applicator is positioned along the conveyor line to deposit plastic like material directly over the items in order to secure the items to the covers. In this embodiment, folded flaps are not required to secure the items to the covers. After an item is placed on a cover, a plastic like shell is applied over the item to secure the item to the cover. In one aspect, the plastic like material mates with a bead of adhesive and in another aspect, the plastic like material is provided with its own sticky perimeter to mate with the cover of the printed material. To remove the items from the covers, the plastic like material is simply peeled off to allow access to the items, or the covers may be provided with removal perforated flaps or slots much like those previously mentioned. In this embodiment, because no extra material or stock is needed to create pockets on the covers, no extra expense is incurred since oversized covers need not be provided.

In a preferred embodiment, as noted, the covers are provided with cut-out openings allowing the items to be displayed through the covers of the printed materials. The cut-out openings are preferably smaller in size than the portions of the items being viewed so that the items do not inadvertently fall through the covers. Moreover, if the printed material is placed on a magazine rack, although the item is preferably viewable to potential purchasers without them having to pick up and open the magazine as a result of the cut-out portion in the cover opposite a portion of the item, the item is not accessible to the potential purchaser absent the potential purchaser causing damage to the cover of the magazine in what could be characterized as an attempt to steal or misappropriate the item. The covers can be provided with the cut-outs prior to being placed on the conveyor line, or a die-cut device can be appropriately positioned along the conveyor line to cut out the desired portions of the covers in the same in-line process of the present invention.

In one aspect of the present invention, the items are secured to the covers in-line with the process for producing the completed printed materials, e.g., magazines, thereby increasing the efficiency of the overall process.

The present invention also teaches a method of securing items to covers of printed materials and thereafter attaching the covers to at least one signature. The method includes the steps of providing a stream of covers, placing items having a smaller surface area than the covers on the covers, securing the items to the covers with an adhesive application, and, preferably, securing the cover to at least one signature. In one embodiment, the covers are folded to create flap portions whereby the items are placed thereunder, and the flap portions are secured to the covers thereby providing envelope areas wherein the items are secured. In another embodiment, the items are secured to the covers by way of a plastic like jacket applied directly over the items. In preferred embodiments, the covers are provided with observation holes which allow the items to be viewed without having to open the covers. Various arrangements ensure that the items will remain secured to the covers absent an intervening force but which also allow the items to be removed from the covers when it is desired to do so.

Accordingly, a feature of the present invention is to provide an apparatus and a method which secure items to covers of printed materials so that the items may be displayed on or through the covers thereby providing certain promotional or advertising benefits as well as providing the ultimate end user an added gift.

Another feature of the present invention is to provide an apparatus and a method which secure items to covers of printed materials which inhibits inadvertent removal of the items from the covers, and which prevents easy theft of the items from the covers.

A further feature of the present invention is to provide an apparatus and a method which secure items to covers of printed materials in a way in which the items, covers and printed materials arrive to the end users in a safe, usable condition.

Yet another feature of the present invention is to provide an apparatus and a method which secure items to covers of printed materials in a manner which reduces the individual handling of the items, covers and signatures of the printed materials until the printed materials are substantially entirely completed, thereby reducing the likelihood of damaging the items, covers, and/or the signatures during processing.

Still another feature of the present invention is to provide an apparatus and a method which secure items to covers of printed materials and thereafter, in and on the same processing line, secure the covers to book blocks. The versatility of the present invention, however, is such that the items could be secured to the covers for printed materials in one processing line and, thereafter, transferred to another processing line where the covers are attached to book blocks.

Other features and advantages of the invention will become apparent to those skilled in the art upon review of the following detailed description, claims and drawings in which like numerals are used to designate like features.

Figure 1:
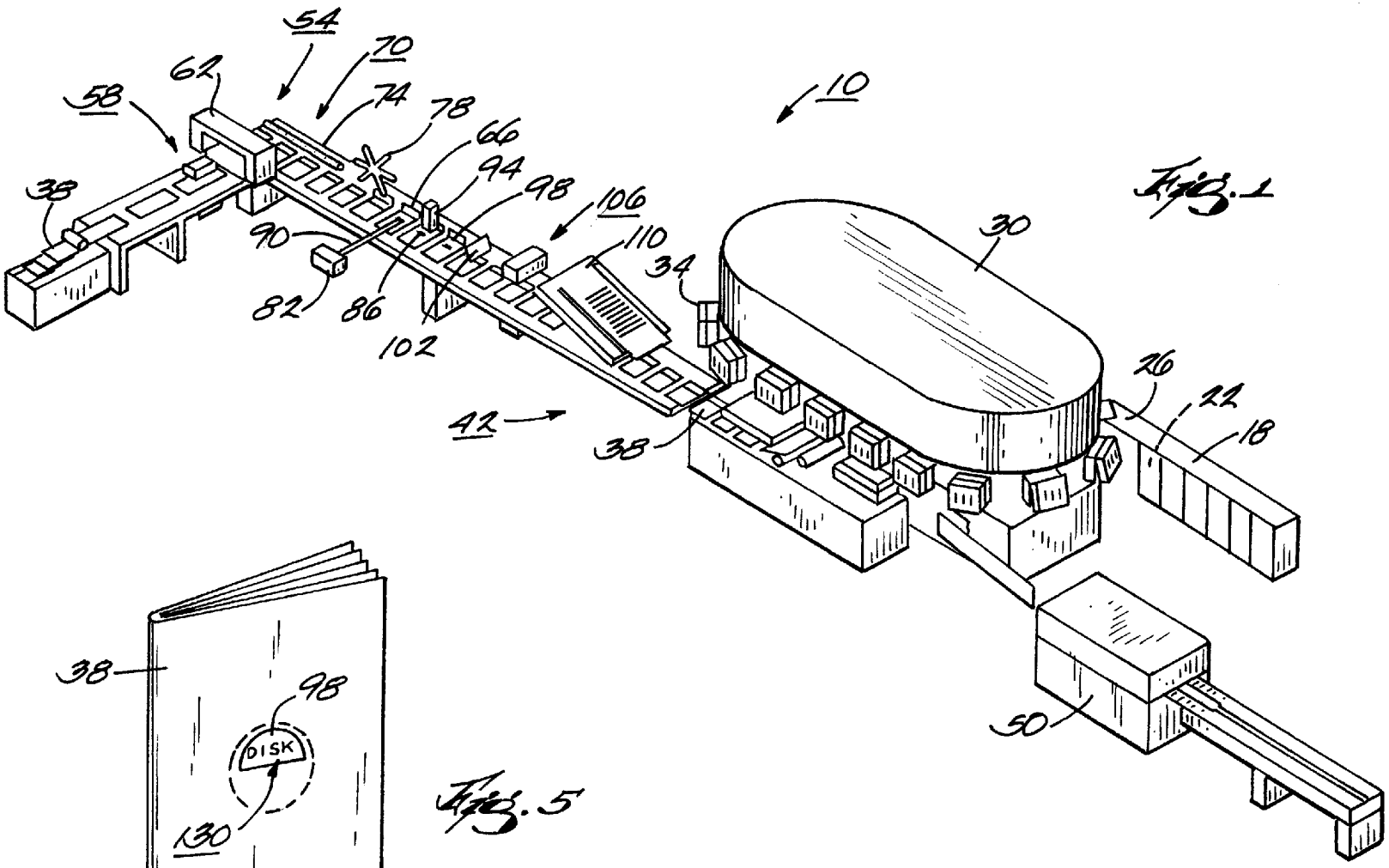
FIG. 1 is a perspective view of a portion of a binding system employing the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof. The use of letters to identify steps of a method or process is simply for identification and is not meant to indicate that the steps should be performed in a particular order.

DETAILED DESCRIPTION OF THE PREFERRED EMBODIMENTS

Figure 3:
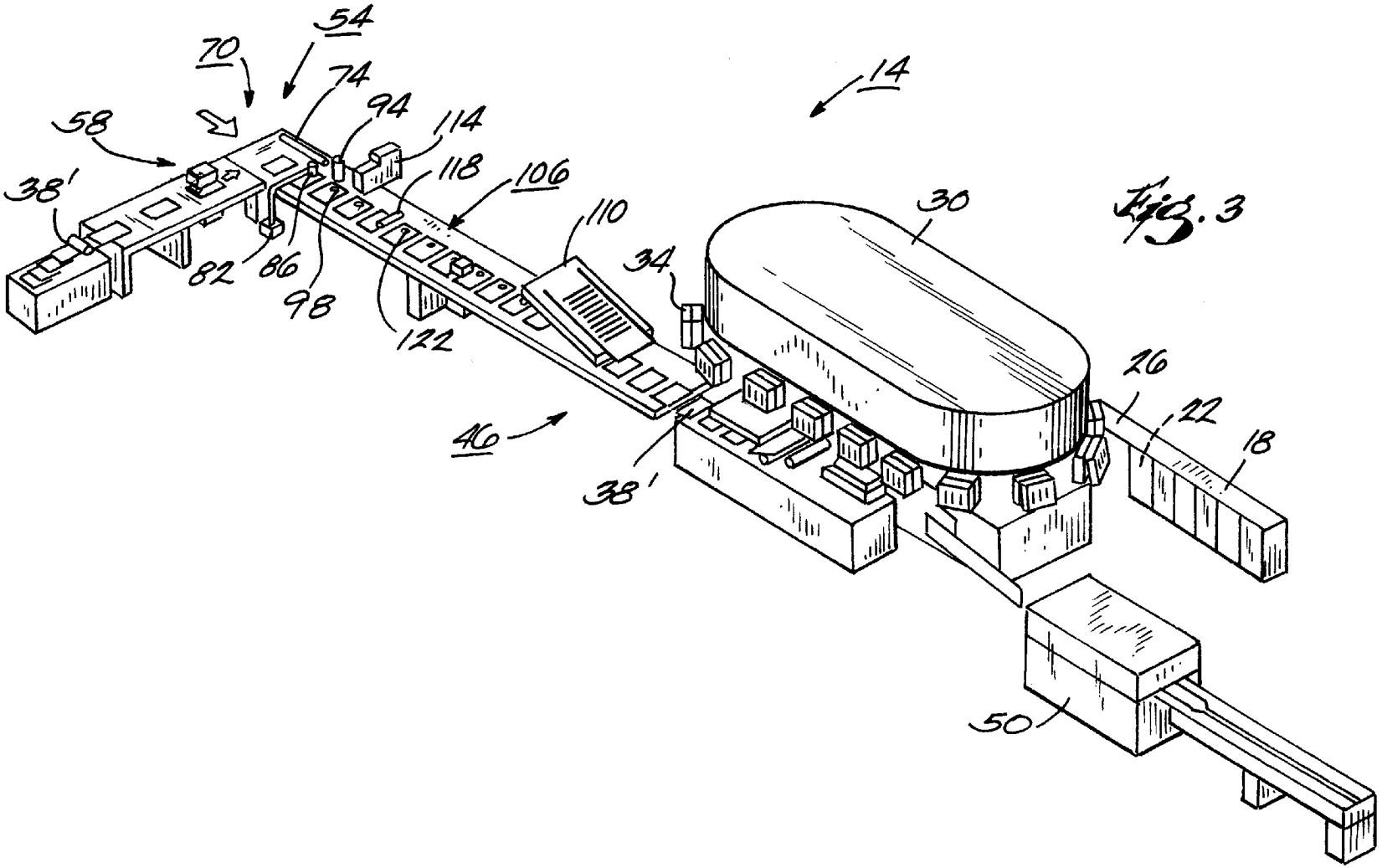
FIG. 3 is a perspective view of a portion of another binding system employing the present invention.

FIGS. 1 and 3 illustrate binding systems 10 and 14, respectively, which can be employed to produce various magazines, catalogs, brochures, periodicals, or other printed products containing items secured to covers (e.g., covers or cover wraps) according to the principles of the present invention. The illustrated systems 10 and 14 include gatherers 18 that gather signatures into book blocks 22, and provide the book blocks 22 to collating conveyors 26. The collating conveyors 26 transport the book blocks 22 to perfect binders 30, where the book blocks 22 are transferred to clamps 34 and controllably conveyed around the perfect binders 30. Although a perfect binder 30 is shown, other binders or signature suppliers such as saddle stitch binders known to those skilled in the art are capable of use with the invention according to the principles of the invention. At the perfect binders 30, the book blocks 22 are held along one longitudinal edge so that their respective folds, or backbones, are directed downwardly. In this orientation, each book block 22 is initially trimmed along its held longitudinal edge, and then roughened along its backbone. Following these preparations, covers 38 (FIG. 1) or 38' (FIG. 3) and/or cover wraps (not shown) may be applied to the book blocks 22 by cover applicators 42 (FIG. 1) or 46 (FIG. 3). The covered book blocks are then conveyed to trimmers 50 where edges are further trimmed as desired.

Thereafter, assembled books are transferred to labeling stations (not shown) where mailing labels are printed or otherwise applied, and may thereafter be conveyed to tabbing machines (not shown) at which one or more closure tabs are applied to hold the books closed during mailing. In some instances, removable inserts, which are blown in or otherwise inserted between the pages of books before the books reach the tabbing stations, are also maintained in place by using the closure tabs. Strapping machines (not shown) may also be provided after the labeling stations and/or the tabbing machines to place retaining straps around the books. The finished books may then be routed to wrapping machines (not shown) which bundles and readies them for mail or other distribution. Conventional controllers, like controller 25 shown in U.S. Pat. No. 5,634,633, which has been incorporated herein by reference, are preferably operatively connected to all of the foregoing major components and provide control signals thereto. Moreover, such controllers are capable of controlling other components of the binding systems 10 and 14 as will be apparent below.

The gathers 18, collating conveyors 26, perfect binders 30, trimmers 50, labeling stations, tabbing machines, wrapping machines and strapping machines can be of conventional construction and do not require a detailed discussion. Moreover, other arrangements or other existing printing or binding equipment are capable of use in conjunction with the present invention.

Referring to the binding system shown in FIG. 1, there is provided a stack of covers 38 which are individually fed in a conventional manner to a conveyor line 54. The conveyor line 54 can be any type of conveyor line known to those skilled in the art and which is capable of use according to the principles of the present invention. However, a conventional, readily available, driven endless belt having conventional registration lugs to provide a moving surface for transporting the covers is particularly suitable for use in conjunction with the present invention. The conveyor line 54 should preferably include conventional registering equipment such as, e.g., side to side guides (not shown), to ensure that the covers 38 are properly registered and aligned as they move along the conveyor line 54. Equipment which singularly feeds covers and then registers and aligns the covers as the covers move along a conveyor are known to those skilled in the art and further description is, therefore, not necessary.

The covers 38 are preferably fed to the conveyor line 54 in an unfolded state for reasons which will become clear below. A cover as attached to a book block typically includes four pages: page 1 is generally referred to as the title page or front cover; page 2 is generally referred to as the inside front cover page; page 4 is generally referred to as the back page or back cover; and page 3 is generally referred to as the inside back cover page. As known, a fold generally separates pages 1 and 2 from pages 4 and 3. Preferably, as shown, the covers 38 are fed to the conveyor line 54 with pages 2 and 3 facing upward or away from the conveyor line 54 and pages 1 and 4 facing downward or toward the conveyor line 54.

Figure 2:
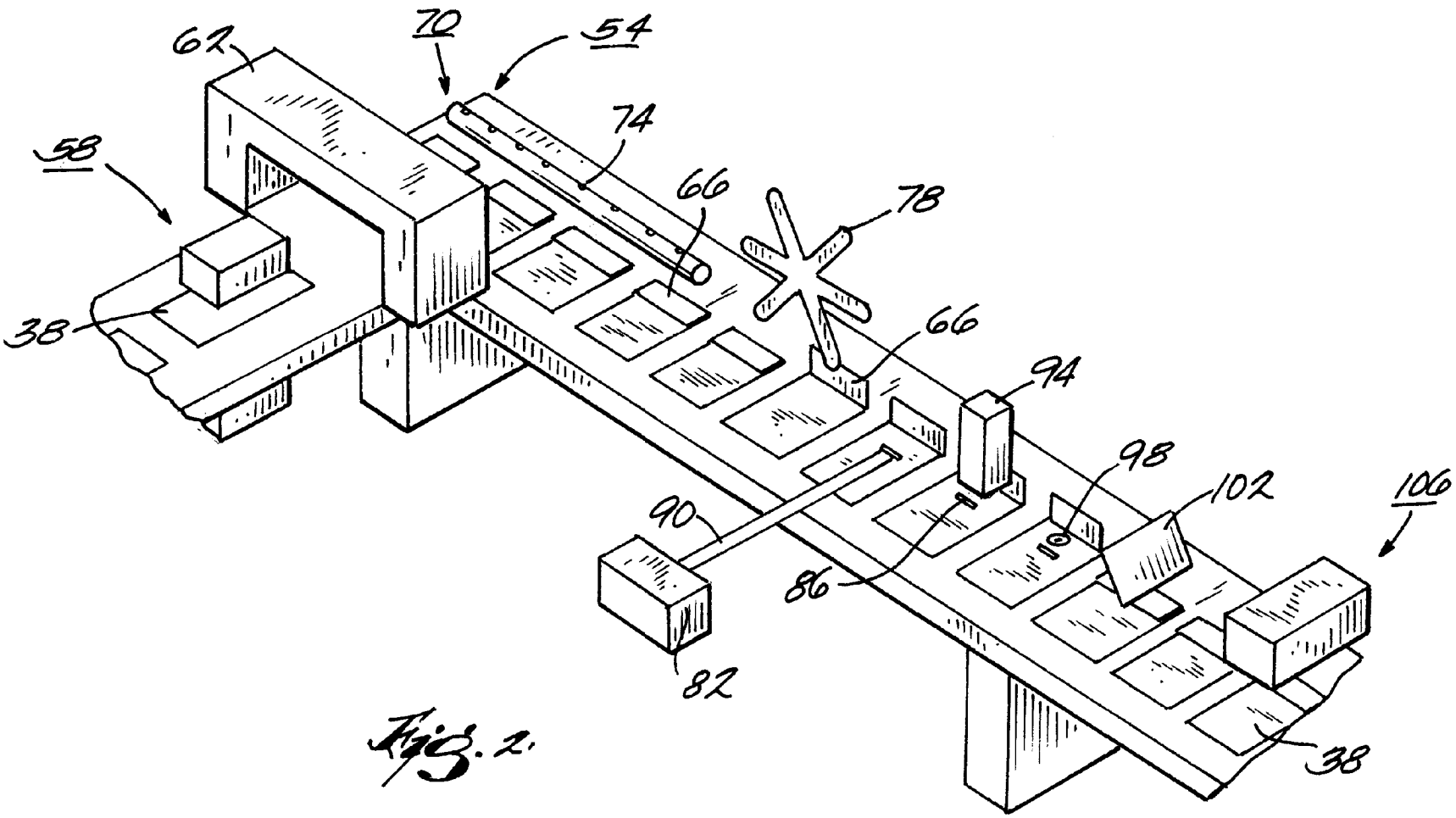
FIG. 2 is a perspective view of a portion of the binding system of FIG. 1.

With continued reference to FIG. 1 and with additional reference to FIG. 2, a first print area 58 is optionally positioned along the conveyor line 54. If utilized, preferably, the print area 58 includes a contactless, ink jet printer so that personalized indicia can be provided on the covers 38. Such personalized indicia can, for example, be geographically or individually related to the recipient of the final printed product. The printer may be positioned above and/or below the conveyor line 54 and should have the ability to print onto any or all portions of pages 1–4 of cover 38. Preferably, for printed materials in the United States, the first print area 58 provides "right reading", i.e., parallel to the head/foot of the cover 38.

In the embodiment shown in FIGS. 1–2, the covers 38 are conveyed to a folding mechanism 62. The folding mechanism 62 can be any number of different folding mechanisms known to those skilled in the art and readily available from numerous commercial sources. A folding mechanism designed to apply single-folds to the covers is preferred; however, a folding mechanism which creates multiple folds could be used according to the principles of the present invention.

According to a preferred aspect of the present invention, the folder 62 creates single flap portions 66 in the covers 38 by folding a top portion of page 2 over and onto the remainder of page 2 as shown in FIG. 2. The covers 38 in their unfolded state must be sufficiently long enough to accommodate the flap portions 66. For example, for an 8½×11 inch book having a 4 inch folded flap portion designed to create a pocket for a promotional item (further explanation to follow), the flat cover 38 fed from the cover stack must be at least 8⅙×26 inches and, in addition, include enough paper to accommodate the thickness of the printed material.

Continuing down the conveyor line 54, once folded, it is preferable to register and align the covers 38 in registration area 70. After traveling through the folder 62, the conveyor line 54 causes the covers 38 to preferably change directions by ninety degrees. Although other conventional registration techniques may be employed, the covers 38 may contact stop bar or registration guide 74 which assists lugs on the conveyor line 54 to pick up the covers to ensure the covers move down the line in the desired fashion. It should be understood that other registration equipment generally known may be advantageously placed along the conveyor line 54 as needed to enhance the overall process and product produced by the process.

As shown in FIGS. 1 and 2, the nature and size of the single flap portions 66 are such that, once folded, they tend to lay down flat against the remainder portion of the covers 38. However, it is envisioned that certain covers made of thicker material and/or manipulated through various types of folders may be produced which would enable the flap portions 66 to stand up generally normal to the conveyor line 54. For those applications where the flap portions 66 generally lay flat or are caused to lay flat, flap opener 78 is provided and properly positioned along the conveyor line 54. Such opening devices are commonly known to those skilled in the art and readily available from many commercial sources. However, a flap opener device which applies a small vacuum or suction against the flap portions 66 to open the flap portions 66 works well with the present invention. One such vacuum opener which is well suited for use with the present invention is available from Sitma of Italy. Such an opener 78 is a rotating star-shaped opener having vacuum or suction ports on each end of a respective arm which extend radially outward from a central portion of the star. The opener 78 is preferably caused to rotate such that as each successive cover 38 moves down the line, the next arm in the opener is rotated in sufficient amount to cause the flap portion 66 of that cover 38 to open.

Still referring to FIGS. 1 and 2, an adhesive applicator 82 is positioned along the conveyor line 54. The applicator 82 applies a predetermined pattern of adhesive 86, generally referred to as pattern gluing, to an appropriate area on the covers 38 such as on page 2. For example, the pattern of adhesive 86 can be a single strip, multiple strips or circular adhesive strips. Adhesive applicators are commonly known to those skilled in the art and are available through a number of sources, such as, e.g., Nordson Corporation of Duluth, Georgia. Generally, the adhesive applicator 82 selectively meters adhesive 86 through a delivery hose or tube 90 to a dispensing nozzle (not shown) mounted above the covers 38. If desired, multiple tubes and/or dispensing nozzles may be used to deposit the. adhesive in a desired pattern. For reasons provided below, the adhesive 86 may be a releasable adhesive. The releasable adhesive may be, for example, a pressure sensitive adhesive available from H. B. Fuller Corporation of St. Paul, Minn., and sold under the name of HL-2198. Alternatively, for reasons also provided below, a stronger more permanent adhesive generally known to those skilled in the art and readily available may be applied. As shown, adhesive 86 is applied to a portion of the inside front cover page beneath the flap portions 66. As noted, however, consistent with the teachings herein, the adhesive 86 may be applied elsewhere, such as directly on the items (discussed below), and still accomplish the desired features according to the present invention.

Referring still to FIGS. 1 and 2, an item feeder 94 is positioned along the conveyor line 54 to deliver selected items, one at a time, to the covers 38. In the preferred embodiment, the item feeder 94 is positioned downstream from the adhesive applicator 82 and positioned over the conveyor line 54 so as to deposit items 98 on the covers 38 without placing the items 98 on the adhesive 86. However, the item feeder 94 may be positioned upstream of the adhesive applicator and still accomplish the features of the present invention. Moreover, the items 98 may be placed directly on top of the adhesive, preferably releasable adhesive, or the adhesive, preferably releasable adhesive, can be applied directly to the items 98. In the illustrated embodiment, the items 98 are CD-ROMs or diskettes. However, the items may be cards, fashion accessories, condiment samples, or anything suitable for attachment to covers of printed materials. Item feeders are generally known to those skilled in the art, but a Pick 'n Place feeder available from Sitma of USA is suitable for use in combination with the other components of the present invention. In a preferred embodiment, the flap opener 78 is positioned along the conveyor line 54 upstream of the item feeder 94 to ensure that the flap portions 66 on the folded covers 38 are opened prior to the placement of the items 98 on the covers 38. In a preferred arrangement, the adhesive 86 is applied to portions of the covers 38 which ultimately mate with the flap portions 66 to create the envelope areas for the items 98. The adhesive 86 may be deposited on the covers 38 before or after the placement of the items 98 on the covers 38 under the flap portions 66. In any event, once the flap portion 66 falls back down, the flap will be secured to the covers 38 thereby providing the enveloped areas or pockets in which the items 98 are secured.

For certain covers 38, it may be desirable to provide a flap closer 102 downstream from the item feeder 94. Flap closer 102 may be any suitable device adapted to allow covers 38 to travel thereunder and adapted to force flap portions 66 by contact or otherwise to fall down onto the mating portions of the covers 38. The flap closer 102 can also be adapted to force the flap portions 66 down onto the strategically deposited adhesive 86 thereby further ensuring that the items 98 are firmly secured to the covers 38 in the created envelope areas between the flap portions 66 and covers 38. It is envisioned that certain flap portions may be capable of desirably falling down on their own which would eliminate the need for the flap closer. Such will depend on the characteristics of the covers 38 used.

Optionally, a second print area 106 akin to the first print area 58 may be provided along the conveyor line 54 downstream of the flap closer 102 as shown, or in any other desirable location along the conveyor line 54. If utilized, preferably, a noncontactless printer is provided to print parallel to the spine of the printed product on either side (i.e., front or back) of the covers 38. Alternatively, all points addressable noncontactless printers, known to those skilled in the art, may be used.

As shown in FIG. 1, a cover feeder 110 may be utilized such as the cover feeder shown and described in U.S. Pat. No. 5,634,633, which has been incorporated herein by reference. For example, if certain covers 38 are to include secured items therein but other certain covers are not intended to include additional items secured thereto, the cover feeder 110 could feed blank covers to the conveyor line 54 which would then be attached to the book blocks. This operation can be optimized to enhance posted savings in the mailing of the printed materials through the strategic processing of the printed materials.

Covers 38 with the inserted and secured items 98 are then fed from the apparatus 42 to the apparatus 30 where the covers 38 are attached to the rest of the magazines or book blocks 22 to complete assembly of the printed materials.

Figure 4:
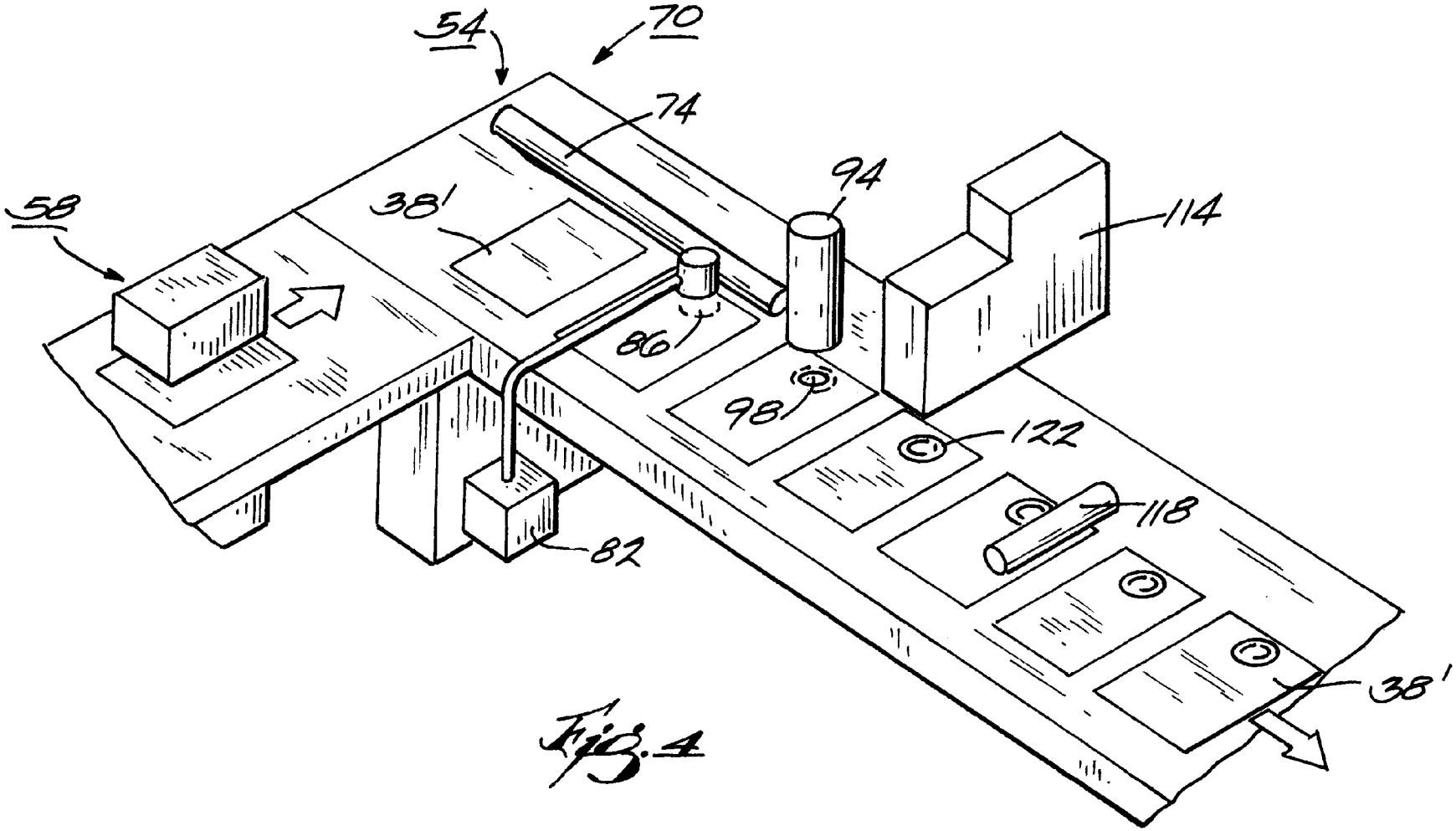
FIG. 4 is a perspective view of a portion of the binding system of FIG. 3.

Reference is now made to FIGS. 3 and 4 illustrating the second binding system 14. The binding system 14 is similar to the binding system 10 except the folding mechanism 62, the flap opener 78, and flap closer 102 have been removed from the conveyor line 54. Further, a plastic like applicator 114 and a device closer 118 have been added to the conveyor line 54.

Covers 38' are fed to the conveyor line 54 in an unfolded state. After the covers 38' travel through the first print area 58 (if utilized) and are registered and aligned in registration area 70, the covers 38' do not travel through a folder. As will be further explained, the covers 38' as fed to the conveyor line 54, are substantially equivalent to the overall size needed for the printed materials. The covers 38' do not require any extra material to accommodate the items 98 thereby reducing the overall material costs associated with the covers 38'. Thus, for an 8½×11 inch book, the flat cover 38' can be at least 8½×22 inches plus whatever material is needed to accommodate the thickness of the printed material.

An adhesive applicator 82 may be positioned along conveyor line 54. An item feeder 94 is positioned along the conveyor line 54 to deliver selected items 98, one at a time, to the covers 38'. The plastic like applicator 114 is positioned along the conveyor line 54 downstream from the item feeder 94. The applicator 114 can be capable of attaching the items 98 directly to the covers 38', one at a time. The applicator 114 preferably utilizes a releasable, plastic like material 122 to secure the items 98 to the covers 38'. The device known as "The Attacher" and sold by Ga-Vehren Engineering of St. Louis, Mo., can perform this function. In one aspect, the material 122 is comprised of a plastic like material which includes a sticky perimeter which is designed to adhere to the covers 38'. With such a device, the adhesive applicator 82 may be unnecessary.

It should be noted that other types of applicators 114 can be used. For example, the applicator 114 may be any type of plastic or other suitable material dispenser which deposits a material over the items 98 and is secured to the covers directly or by connection with adhesive 86 deposited on the covers by adhesive applicator 82. Moreover, the items 98 could be placed directly on the adhesive 86 without the use of other securing material. In any event, the adhesive 86, material 122 or any other material is suitable to cooperate with the items 98 and covers 38' such that the items 98 can be appropriately removed from the covers 38' when desired, in much the same fashion as that previously discussed.

A closer device 118, preferably a roller, can be positioned downstream from the device 114 to ensure the material used to secure the items 98 to the covers 38' is adequately set around the items 98.

Although not shown, a cover wrap known to those skilled in the art may be wrapped around the book blocks 22 to further inhibit unlawful appropriation of the items 98 secured to the covers or to further protect the printed materials and their contents. In addition, in the event of damage to the book blocks during transportation or handling, the cover wrap may also capture items which happen to become dislodged from the covers prior to the book blocks reaching their final destination.

Figure 5:
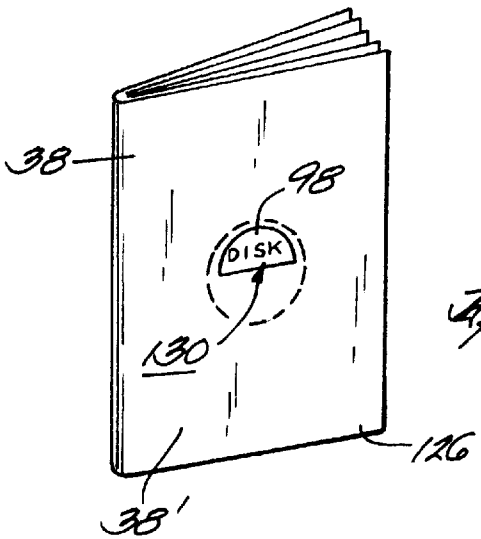
FIG. 5 is a perspective view of a final printed product produced according to the present invention.

FIG. 5 illustrates a final printed product 126 after an item 98 has been secured to a cover 38 or 38' according to a preferred embodiment. As shown, the cover 38 or 38' includes a cut-out or die cut portion 130 which allows the item 98, here a CD-Rom disk, to be viewed through the cover 38 or 38' without the observer having to open the printed material 126. As such, if product 126 is placed on a magazine rack, for example, a potential purchaser would know that if he/she purchases the magazine 126, he/she will receive the item 98 contained therein. This, as can be appreciated, provides valuable advertising and promotional benefits to the publisher and seller of the magazine as well as the manufacturer and seller of the item 98.

Figure 7:
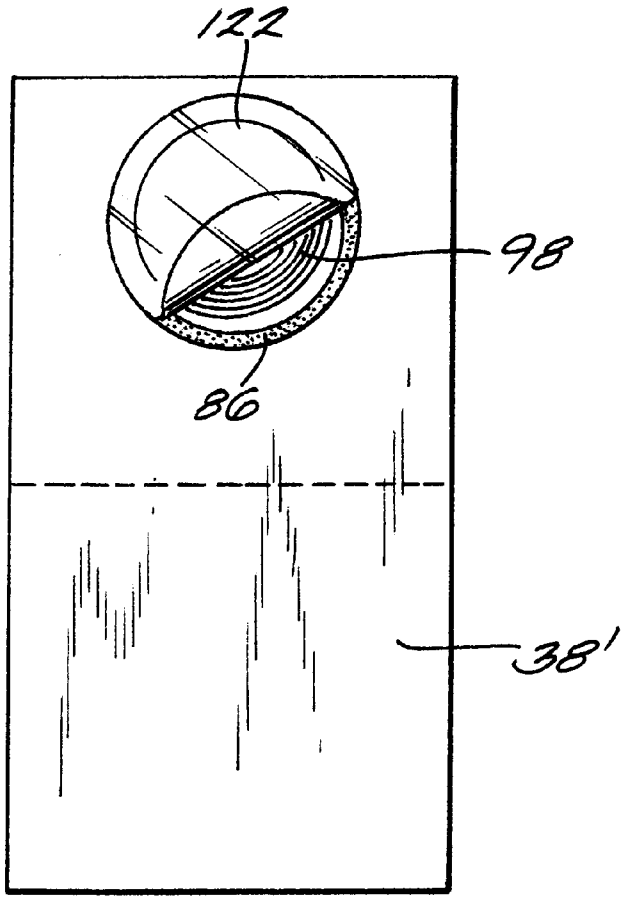
FIGS. 6–7 are top views of covers of printed products showing items secured thereto and illustrating their removal therefrom.
Figure 6:
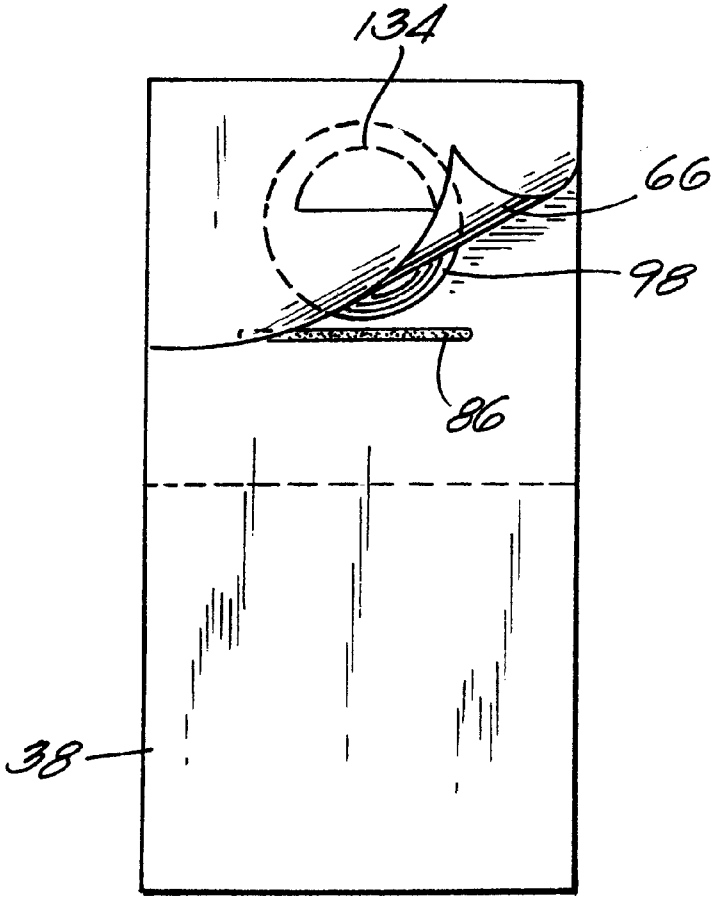

FIGS. 6 and 7 illustrate the inside front pages (including page 2 as described above) of covers 38 and 38' for printed materials as such are processed along cover applicators 42 and 46, respectively, showing how items 98 secured to covers 38 or 38' may be removed from the covers 38 or 38' according to certain aspects of the present invention. As shown in FIG. 6, the flap portion 66 may be pulled back due to the nature of the releasable adhesive 86. Alternatively, the adhesive 86 could be a stronger, more permanent adhesive and the disk 98 could be removed through perforated slot 134. Once the slot is caused to be opened by tearing the perforations, the item can be slid out from the envelope pocket created by the flap portion 66 and the remainder of the cover 38. As shown in FIG. 7, the material 122 is capable of being peeled away from either the releasable adhesive 86 and thus cover 38' or, if material 122 containing a sticky perimeter is used, the sticky adhesive around the perimeter is of such a nature so as to allow the material 122 to be peeled off of the cover 38'. Although not shown, a slot, like slot 134 of FIG. 6, could be provided to allow the item to be removed from the cover.

The illustrated embodiments result in printed products having items secured to the inside surfaces of the covers, as shown. However, it should be appreciated that the principles of the present invention could also be used to attach the items 98 to various other locations. For example, the items 98 could be secured to the outside of the covers by putting flap portions 66 on the outside of the covers 38, or by securing the items 98 to the outside of the covers 38' with material 122.

Because the item 98 is inserted into the cover 38 or 38' in line with the process for producing a complete magazine, the efficiency of the process is increased. The invention may be used in-line with existing manufacturing equipment. Also, because the items 98 are displayed on covers 38 or 38' of printed materials, the advertising benefit of including the items with the printed materials is increased. The items and book blocks are combined so that they arrive at the end users in secured conditions.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. An apparatus for securing items to covers for signatures, comprising:

a cover applicator for attaching covers to signatures;

a signature supplier positioned to provide at least one signature to said over applicator;

a folder positioned along said cover applicator for individually folding the covers so as to create a flap portion on each cover;

an item feeder positioned to feed items in separated relation to the covers such that the items are positioned under the respective flap portions; and an adhesive applicator positioned to deposit adhesive between the flap portion and the cover thereby securing the item to the cover.

2. An apparatus according to claim 1, further comprising:

a flap opener device positioned along said cover applicator to open the flap portions.

3. An apparatus according to claim 2, wherein said flap opener includes a vacuum opener.

4. An apparatus according to claim 3, wherein said vacuum opener is a rotating star-shaped opener having a plurality of vacuum ports such that for each vacuum port which travels past a vertical, a succeeding cover in a stream of covers travels thereunder.

5. An apparatus according to claim 1, further comprising:

a cover feed device positioned to feed covers in separated relation to said folder.

6. An apparatus according to claim 5, further comprising:

a printer positioned between said folder and said cover feed device and being orientated to print onto a surface of each cover fed from said cover feed device.

7. An apparatus according to claim 1, wherein said adhesive applicator applies a releasable adhesive.

8. An apparatus according to claim 1, further comprising:

a printer positioned after said item feeder and being orientated to print onto a surface of a cover.

9. An apparatus according to claim 1, further comprising:

a flap closure device positioned to close the flap portions after the items have been placed under the flap portions and after the adhesive has been applied between the flap portions and the covers.

10. An apparatus according to claim 1, wherein the covers include a cut-out opening such that a portion of the items secured thereto are viewable after the covers have been attached to the signatures.

11. An apparatus for securing an item to a cover for a signature, comprising:

a cover applicator for attaching the cover to a signature;

a signature supplier positioned to provide at least one signature to said cover applicator;

a folder positioned along said cover applicator for individually folding the cover so as to create a flap portion on the cover;

a cover feed device positioned to feed the cover to said folder;

a flap opener device positioned to open the flap portion;

an item feeder positioned to feed an item to the cover such that the item is positioned under the flap portions;

an adhesive applicator positioned to deposit adhesive between the flap portion and the cover;

a flap closure device positioned to close said flap portion after the item has been placed under the flap portion and after the adhesive has been applied between the flap portion and the cover to secure the item to the cover and;

wherein the cover includes a cut-out opening such that a portion of the item is viewable after the cover has been attached to the signature.

12. A method of securing items to covers for signatures, comprising the steps of:

(a) providing a stream of covers;

(b) placing items having a smaller size than the covers in separated relation on the covers;

(c) securing the items to the covers;

(d) attaching the covers to respective signatures; and (e) folding the covers to create a flap portion on each cover and, wherein, step (b) includes placing the items under the flap portions and, wherein, step (c) includes securing the flap portions to the covers.

13. A method according t claim 12, further comprising the step of:

(f) providing openings on the covers such that the items are viewable after step (d) has been completed.

* * * * *

UNITED STATES PATENT AND TRADEMARK OFFICE

CERTIFICATE OF CORRECTION

PATENT NO. : 6,302,388 B1
DATED : October 16, 2001
INVENTOR(S) : William T. Graushar and John C. Geres It is certified that error appears in the above-identified patent and that said Letters Patent is hereby corrected as shown below:

Title page,
Item "[*] Notice:", delete "This patent is subject to a terminal disclaimer."

Column 12,
Line 30, delete "t" and insert -- to --.

Signed and Sealed this

Twenty-first Day of May, 2002

*Attest:*

*Attesting Officer*

JAMES E. ROGAN
*Director of the United States Patent and Trademark Office*